US011027439B2

(12) United States Patent
Levine et al.

(10) Patent No.: US 11,027,439 B2
(45) **Date of Patent: *Jun. 8, 2021**

(54) PROTECTIVE WEAPON

(71) Applicant: ALBL LLC, Gaithersburg, MD (US)

(72) Inventors: Jeffrey C. Levine, North Potomac, MD (US); Joshua D. Levine, North Potomac, MD (US); Evan M. Levine, North Potomac, MD (US)

(73) Assignee: ALBL LLC, Gaithersburg, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/988,168

(22) Filed: May 24, 2018

(65) Prior Publication Data

US 2019/0134829 A1 May 9, 2019

Related U.S. Application Data

(63) Continuation of application No. 14/120,552, filed on Jun. 4, 2014, now Pat. No. 9,987,758.

(51) Int. Cl.
*B26B 1/08* (2006.01)
*F41B 13/00* (2006.01)

(52) U.S. Cl.
CPC ..... *B26B 1/08* (2013.01); *F41B 13/00* (2013.01); *Y10T 29/49828* (2015.01)

(58) Field of Classification Search
CPC . B26B 1/00; B26B 29/02; B26B 27/00; F41B 15/00; F41B 15/08; F41B 13/00
See application file for complete search history.

(56) References Cited

U.S. PATENT DOCUMENTS

| | | | | | |
|---|---|---|---|---|---|
| 1,181,681 | A * | 5/1916 | Nicaud | B26B 29/02 | 30/151 |
| 2,099,447 | A * | 11/1937 | Matsuyama | F41B 15/06 | 463/47.4 |
| 2,741,025 | A * | 4/1956 | Ross | F41B 15/06 | 30/151 |
| 2,845,659 | A * | 8/1958 | Osborne | C08J 9/30 | 264/50 |
| 4,096,629 | A * | 6/1978 | Levine | B26B 1/00 | 30/152 |
| 6,070,326 | A * | 6/2000 | Berns | B26B 29/02 | 30/2 |
| 6,122,828 | A * | 9/2000 | Asterino, Jr. | B26B 3/06 | 30/151 |
| 6,394,518 | B1 * | 5/2002 | Kelley | B25B 27/0092 | 294/61 |
| D500,546 | S * | 1/2005 | Anderson | D22/117 | |
| D510,121 | S * | 9/2005 | Blair | D22/117 | |
| D528,893 | S * | 9/2006 | Budd | D22/118 | |
| 2003/0061714 | A1 * | 4/2003 | Pope | B24D 15/084 | 30/138 |

(Continued)

*Primary Examiner* — Jonathan G Riley
(74) *Attorney, Agent, or Firm* — NovoTechIP International PLLC

(57) ABSTRACT

A self-defense weapon for women and others, comprising a lightweight, portable single or multi-bladed weapon adapted to be held in the hand and when activated by squeezing, one or more blades are exposed outwardly between the fingers. When the hand is relaxed, the weapon is deactivated, and the blades retract into the body of the weapon (sheath) protecting the user, so the weapon may be safely carried in the user's pocket or purse.

19 Claims, 5 Drawing Sheets

(56) References Cited

U.S. PATENT DOCUMENTS

| | | | | |
|---|---|---|---|---|
| 2010/0236077 | A1* | 9/2010 | Shirey | B26B 1/02 30/152 |
| 2012/0066910 | A1* | 3/2012 | Shantha | B26B 1/02 30/122 |

* cited by examiner

PROTECTIVE WEAPON

CROSS-REFERENCE TO RELATED APPLICATION

This application is a continuation of Levine et al., U.S. patent application Ser. No. 14/120,552, entitled "Protective Weapon," filed on Jun. 4, 2014, incorporated herein by reference in its entirety.

STATEMENT OF INVENTION

This invention generally relates to portable self-defense weapons for women and others, and is particularly concerned with a single or multi-bladed weapon that is easily and rapidly employed to fend off an attacker.

BACKGROUND

Animals and birds have sharp claws to both attack and defend against predatory animals for survival. Without these natural assets, women need a similar artificial weapon to fend off predators.

In the past many non-conventional knives and blades have been proposed for different purposes that are carried or supported by the human hand, with many being used for cutting, scraping, tearing, or penetrating.

For example, multiple fixed bladed weapons attached to handles, in which the blades are continuously exposed, have been available for many years. In another example, a multi-bladed weapon is disclosed in U.S. Pat. No. 4,096,629 A whereby the blades are not continuously exposed, but stored in the handle, and activated by a mechanical mechanism to project and retract the blades back into the handle upon operation by the user.

SUMMARY OF THE INVENTION

The present invention provides for a small, portable, lightweight, easy to use single or multi-bladed weapon that can be carried and safely stored by the user, yet rapidly activated when needed to repel an assault. Unlike earlier patents, the blade or blades are fixed length and not moveable, and a retractable protective means normally isolates the blades in the body of the weapon to protect the user when not activated. To activate, the user squeezes the weapon, the retractable protective spring means constricts, and exposes the fixed length blade or blades for use against an attacker. When the user relaxes their grip, the retractable protective spring means expands to again sheathe the blade or blades in the body of the weapon and protect the user from the blades.

This weapon may be similar in appearance and function to animal claws or talons, or pointed cutting blades, and used the same way animals do to repel attacks, or may be a penetrative blade for use against predators. This single or multi-bladed weapon is hand held, lightweight, portable and when squeezed, constricts the compressible spring means resulting in the cutting or stabbing end of the blades protruding between and beyond the users fingers, and used in a "cutting, slashing or penetrating" action as the blades are applied against the body of the attacker. Although no special skills, training, or strength is required on the part of the user, the device is highly effective.

In preferred embodiments, the blade or blades are small, spaced apart in parallel according to the width of the fingers, and normally contained or sheathed within the retractable protective spring means and rigid upper member designed to sheathe the blades, guide the blades during use, and provide structural rigidity. This retractable protective spring means automatically expands when the weapon is not in use, to sheathe the blade or blades and safely carry the device in the hand, pocket, or purse, without danger to the user. In use, the person squeezes the weapon, which constricts the retractable protective spring means, exposing the cuffing or penetrating edges of the blades. This weapon is designed to be small, portable, lightweight, easy to use and functional for defense when needed. Unlike earlier patents, the blades are fixed length, movable only with respect to the users hand, and only exposed for use when the user squeezes the retractable protective spring means to expose the blade or blades, as a claw or penetrating weapon.

This weapon may have a strap means attached to the rigid upper portion, rigid lower portion or both, that fastens around the outside of the users hand and is expandable to fit most users hands. The strap means may be expandable material or two separate straps attachable by attachment means such as snaps, Velcro, or other materials. The strap means will prevent the user from inadvertently dropping the weapon or having it removed by the attacker during use.

DETAILED DESCRIPTION OF PREFERRED EMBODIMENT

Figure 1:
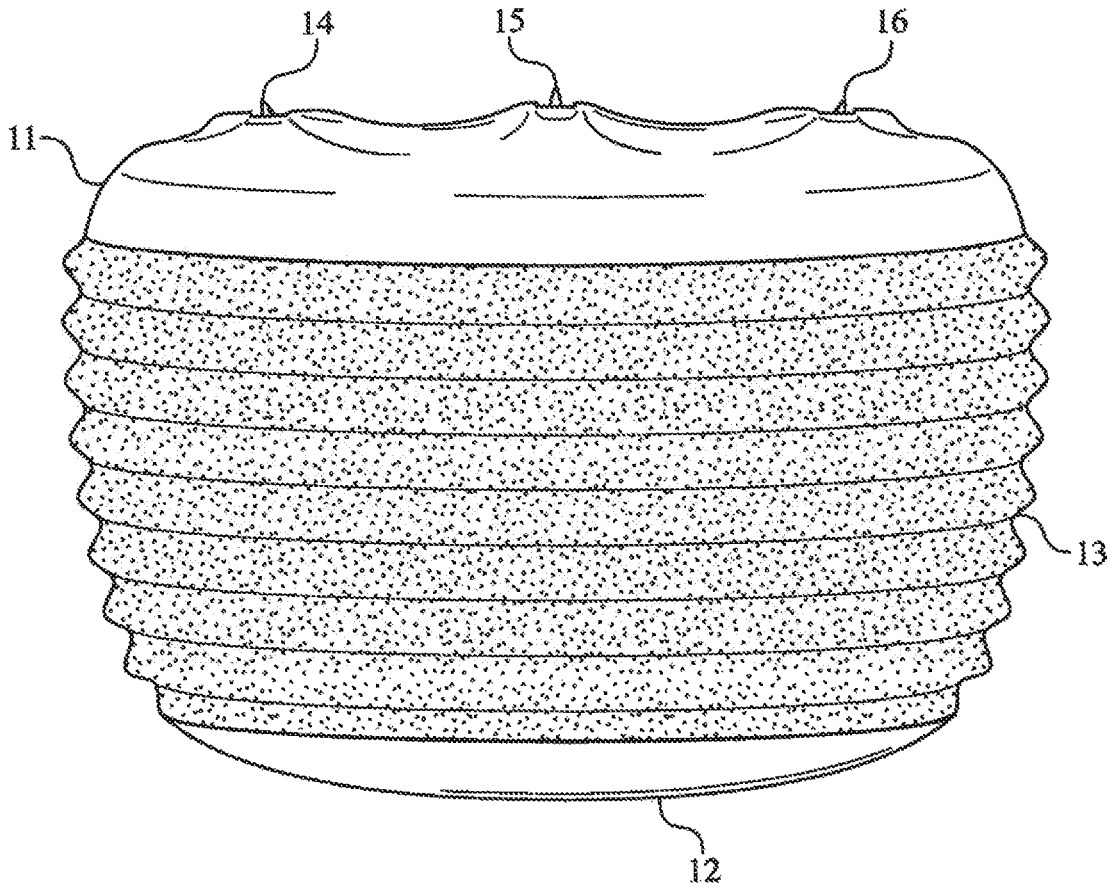
FIG. 1 is a perspective view of the preferred embodiment when the weapon is in a relaxed mode and not in use.
Figure 2:
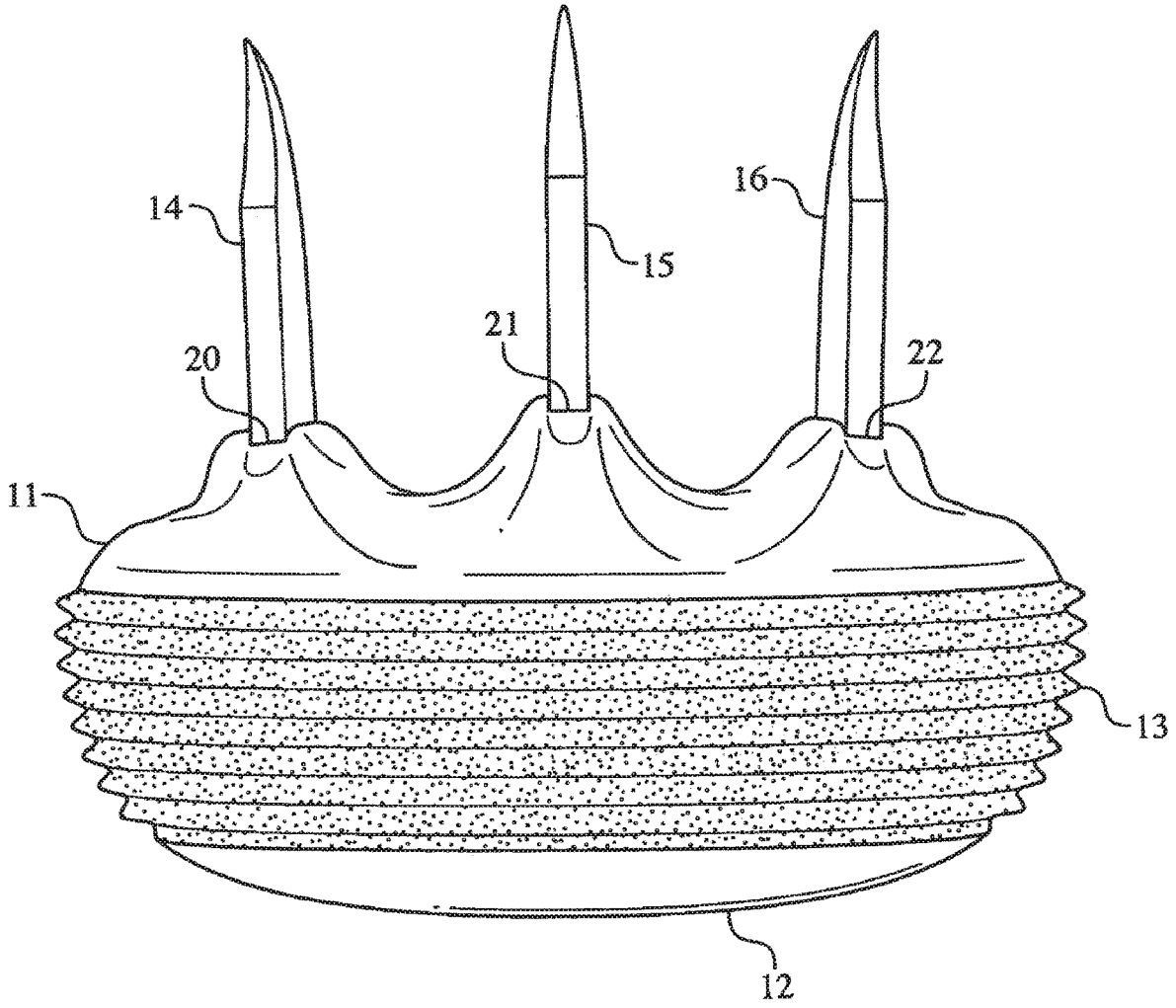
FIG. 2 is a perspective view of the preferred embodiment when the weapon is compressed and ready for use.
Figure 3:
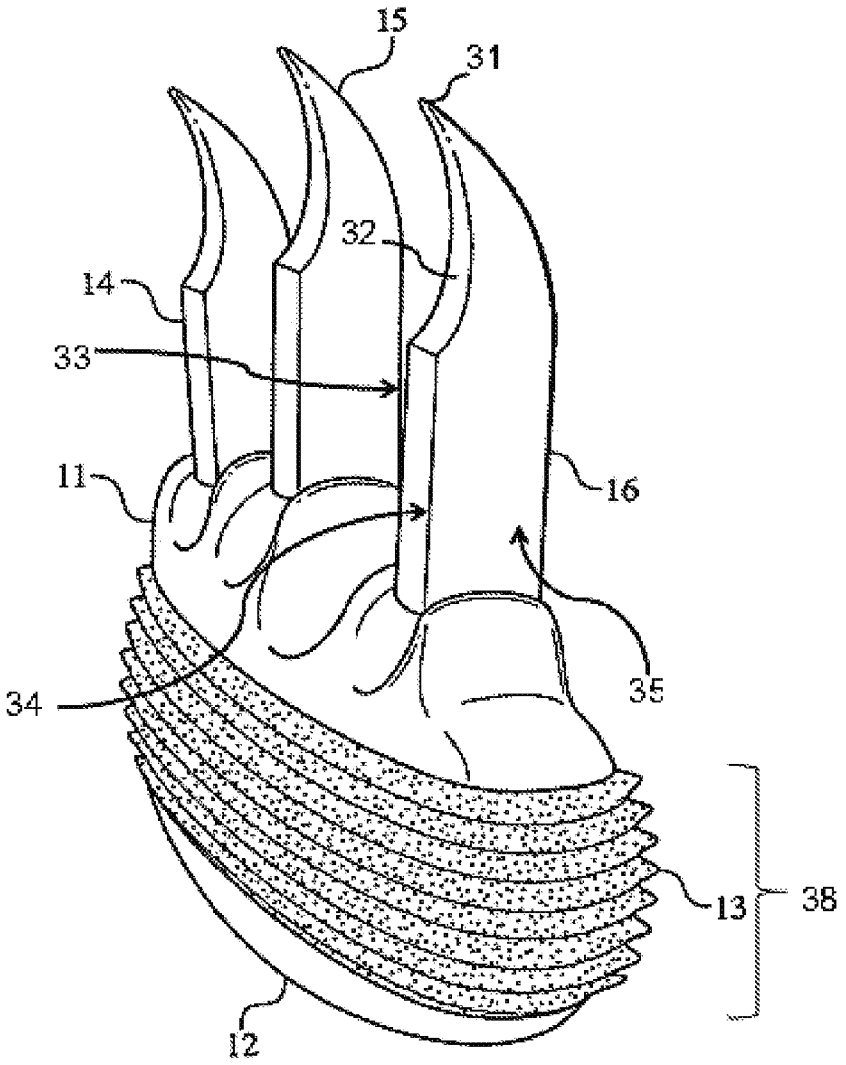
FIG. 3 is a cross sectional view of FIG. 2 when the weapon is compressed and ready for use.
Figure 4:
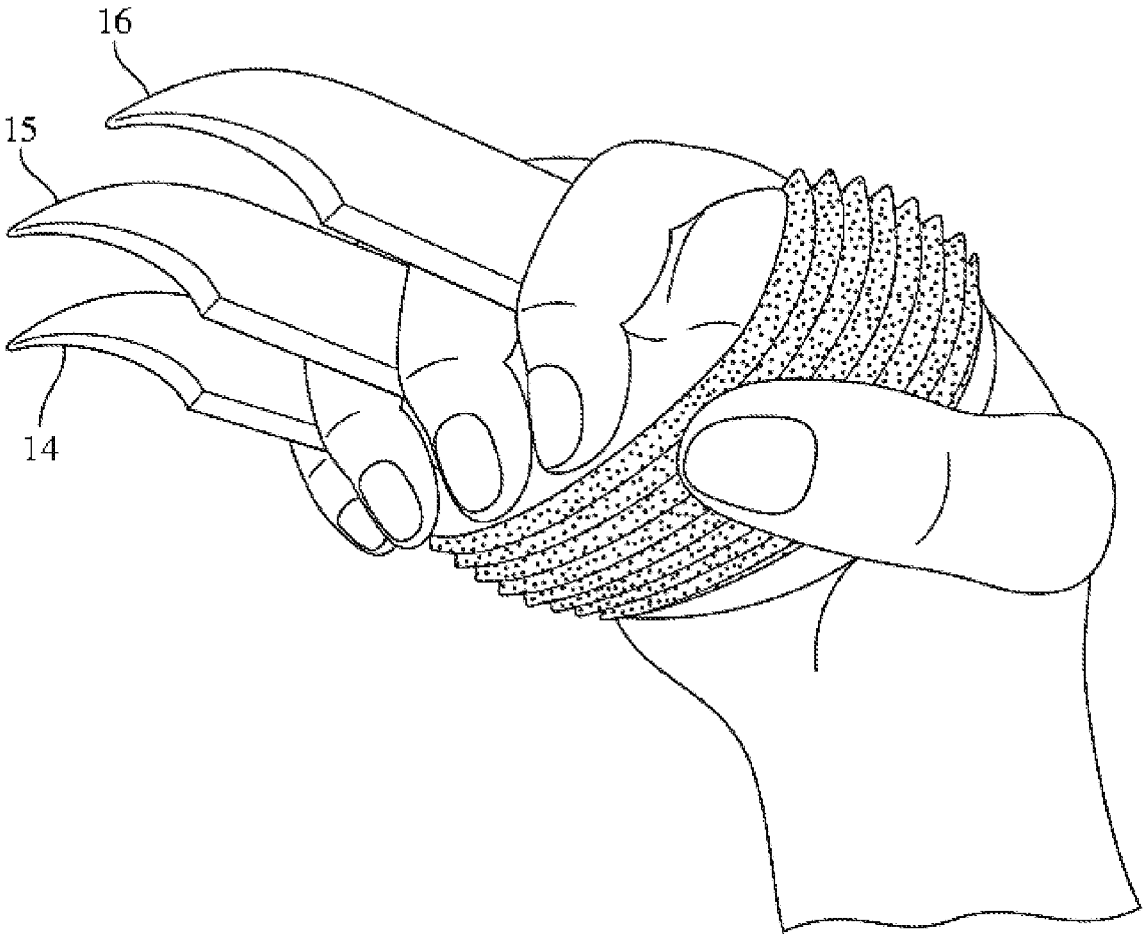
FIG. 4 is a cross sectional view of FIG. 3, when compressed by the human hand, with blades exposed and ready for use.
Figure 5:
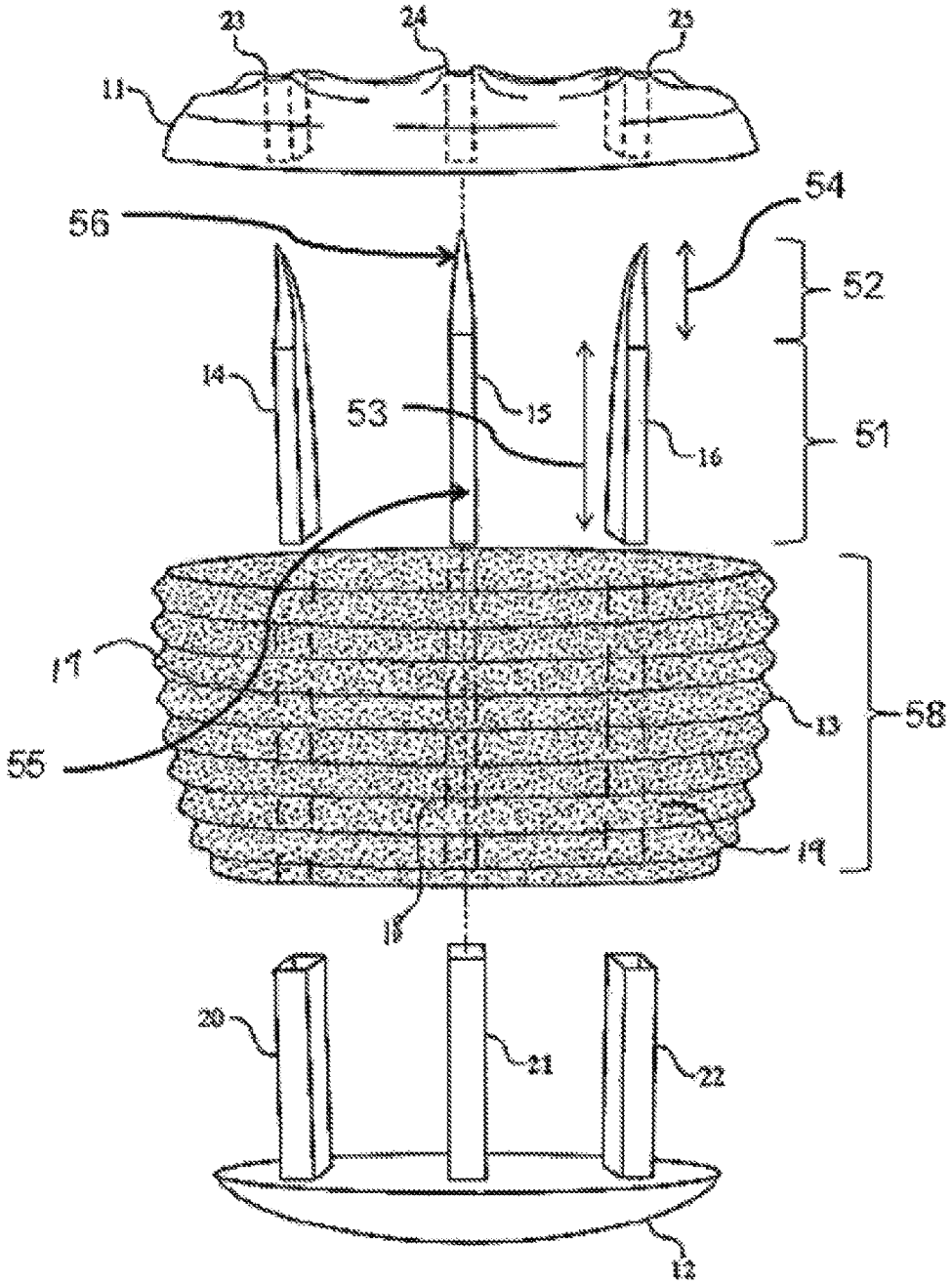
FIG. 5 is an exploded view of the component parts of the weapon prior to assembly.

In FIG. 1, a deactivated state of the weapon is shown, while in FIGS. 2-4, the weapon is in an activated state. Referring to FIGS. 2-5, it can be seen that the weapon includes a first blade 14, a second blade 15, and a third blade 16, which may collectively be referred to as blades 14, 15, and 16. In one implementation, the blades 14, 15, and 16 are disposed in a substantially parallel arrangement. Each blade comprises an upper portion extending from an elongated body portion. For example, in FIG. 5, the third blade 16 includes a body portion 51 and an upper portion 52. Furthermore, it can be seen that the body portion 51 includes a first length 53, and the upper portion 52 includes a second length 54, and that the first length 53 is greater than the second length 54. The body portion 51 can be substantially blunt in some implementations. As shown in FIG. 3, for purposes of reference, the body portion includes a forward-facing surface ("forward surface") 34, a first side surface 33, and a second side surface 35. The forward surface 34 extends between the first side surface 33 and the second side surface 35. In some implementations, the forward surface 34 is substantially blunt, smooth, and/or flat or planar. In one implementation, the forward surface 34 has a substantially rectangular shape, as shown in FIG. 5. Similarly, the first side surface 33 and/or the second side surface 35 can also be substantially blunt, smooth and/or flat or planar in some implementations, as shown in FIG. 3. The body portion 51 can be understood to include a greater thickness than the upper portion 52 in some implementations. In addition, it can be seen that the upper portion 52 includes a concave surface 32 that extends from the forward surface 34 to an outermost tip portion 31. The concave surface 32 curves inward relative to the forward surface 34 and terminates at a sharp pointed end on the outermost tip portion 52. The forward surface 34 can also be understood to include a first width 55, while the concave surface 32 includes a second width 56, and the first width 55 is greater than the second width 56. In some implementations, the concave surface 32 tapers in width as it approaches the outermost tip portion 52. In addition, the blades 14, 15, and 16 are disposed or secured within a sheath casing, where the sheath includes a flexible and compressible housing portion (identified as semi-rigid material 13 in the figures) that extends between a rigid upper member 11 and a rigid lower member 12. The rigid upper member 11 is more rigid than the compressible semi-rigid material 13. Furthermore, referring to FIGS. 1-4, it can be seen that in the deactivated state the body portion is disposed entirely within the sheath while in the activated state at least a portion of the body portion extends out of the sheath. In addition, the height of the housing portion (semi-rigid material 13) can decrease as the weapon transitions from the deactivated state to the activated state. For example, in the activated state shown in FIG. 3, the housing portion has a first height 38, and in the deactivated (uncompressed) state shown in FIG. 5, the housing portion has a second height 58, where the first height 38 is less than the second height 58. In order for the blades 14, 15, and 16 to be exposed when the weapon is in the activated state, in the activated state the first height 38 of the housing portion is substantially smaller than the first length 53 of the body portion 51. Furthermore, as shown in FIGS. 1-5, it can be understood that the upper portion 52 extends entirely out of the sheath in the activated state and the upper portion 52 is substantially enclosed within or surrounded by the rigid upper member 11 in the deactivated state. As described herein, the weapon is configured to transition from the deactivated state to the activated state when a compressive force is applied to the rigid upper member 11 and the rigid lower member 12, and to elastically return to the deactivated state when the compressive force is removed.

Referring to FIG. 1, the weapon's handle/sheath comprises a rigid upper member 11, and a rigid lower member 12, interconnected together by flexible compressible spring means such as semi-rigid material 13. This material may be foam, sponge, rubber or foam plastic material, or other compressible material that is flexible and has sufficient resistance to expand when not in use. One or more of a series of blades 14, 15, and 16 are spaced equidistant apart by the width of the human finger, and fixedly attached to the rigid lower member 12, or aligned slots in lower member FIGS. 5, 20, 21, and 22 and project in a perpendicular manner away from the rigid lower member 12. The blades 14, 15, and 16 are adapted (as shown in FIG. 5), to pass through a series of aligned slots in the flexible spring means 17, 18, and 19. The rigid upper member 11, also has aligned slots (FIG. 2) 23, 24, and 25, through which the blades 14, 15, and 16 are also adapted to pass through when the weapon is squeezed to expose the blades as shown in FIG. 2. The blades, 14, 15, and 16, project vertically away from the rigid lower member 12, and when not in use, the blades 14, 15, and 16 are enclosed within the retractable protective spring means 13, as shown in FIG. 1, and rigid upper member 11, for safe storage when the weapon is not activated.

In operation, when the hand is clenched as shown in FIG. 4, and the retractable protective means 13, squeezed, the blades 14, 15, and 16 pass through both the slots of the retractable protective means 17, 18, and 19 and slots of the rigid upper member 23, 24, and 25 as shown in FIG. 5, and between and beyond the users fingers. The weapon is then activated and ready for use.

This weapon has been designed to be small, portable, lightweight, and effective; resulting in a highly functional piece of equipment, as shown in FIGS. 1 through 4.

Although not intended or designed as a lethal weapon, the shape/configuration of the blade or blades 14, 15, and 16 may be varied, to provide a sharp claw-like blade, a flat sharp bladed edge, a serrated edge, a sharp conical point, or other cutting edge as desired. The materials used may also be varied including metals, plastics, springs, sponges or other materials for the blades and holder/sheath and other elements shown and described. The rigid upper member 11 may contain indolations or finger guides between the rigid upper member slots 23, 24, and 25 to prevent the blade or blades 14, 15, and 16 from coming in contact with the fingers when the weapon is squeezed. In addition, the rigid upper member, 11, may contain suitable external markers/guides (not shown in drawings) to inform the user to hold the weapon with the cutting edges of the blades 14, 15 and 16 pointed toward the attacker and away from the user.

The handheld weapon may also include (not shown in drawings) a strap means attached to the rigid upper portion, rigid lower portion or both, that fastens around the outside of the users hand and is expandable to fit most users hands. The strap means may be expandable material or two separate straps attachable by attachment means such as snaps, Velcro, or other materials. The strap means will prevent the user from inadvertently dropping the weapon during use.

Method of Manufacture

In the preferred embodiment both the rigid upper member and rigid lower member are molded using high impact plastic or other sufficiently rigid material to effectively perform as a defensive weapon. The rigid upper member and rigid lower are assembled together to be interfitted with one another for reciprocal movement of a blade or blades into and through openings in the flexible spring means and openings in the rigid upper member, and a sponge or other material with sufficient resistance to interconnect the rigid upper and rigid lower members, is attached to both the rigid upper member and rigid lower member with glue or other epoxy, and expandable to separate the rigid upper member from the rigid lower member and sheathe the blade when not in use.

Since these and many other changes may be made without departing from the spirit and scope of this invention, this invention should be considered as being limited only by the following claims.

What is claimed is:

1. A protective weapon configured to transition from a deactivated state to an activated state, the protective weapon comprising:

a housing portion including:

a rigid upper member;

a rigid lower member; and an elastic sheath extending between the rigid upper member and the rigid lower member; and a plurality of blunt blades fixedly attached to the rigid lower member, the plurality of blunt blades including a first blade, the first blade disposed substantially within the housing portion when the protective weapon is in the deactivated state, each blade of the plurality of blunt blades having:

a blunt body portion;

an upper portion joined to the blunt body portion and having a pointed tip; and a forward-facing concave surface adjacent to the pointed tip, wherein the protective weapon is configured to transition from the deactivated state to the activated state when a compressive force is applied to bring the rigid upper member and the rigid lower member into closer proximity.

2. The protective weapon of claim 1, wherein the rigid upper member further includes a first slot and a second slot, and the first slot and the second slot are spaced apart by approximately a width corresponding to a width of an average human finger.

3. The protective weapon of claim 2, wherein the plurality of blunt blades includes a second blade;

the first blade is aligned with the first slot; and the second blade is aligned with the second slot.

4. The protective weapon of claim 1, wherein the elastic sheath is configured to decrease from a first height to a second height when the compressive force is applied.

5. The protective weapon of claim 4, wherein the elastic sheath is configured to return to the first height when the compressive force is removed.

6. The protective weapon of claim 1, wherein the outermost pointed tip of the first blade is disposed outside of the housing portion when the protective weapon is in the activated state.

7. The protective weapon of claim 1, wherein the blunt body portion includes a substantially rectangular cross section along a horizontal plane.

8. The protective weapon of claim 7, wherein the upper portion includes a substantially triangular cross-sectional shape along the horizontal plane.

9. The protective weapon of claim 1, wherein the protective weapon is sized and dimensioned to correlate with an average size of a human palm.

10. The protective weapon of claim 1, wherein a lower end of the first blade is disposed within a receptacle extending from the rigid lower member.

11. A method of manufacturing a protective weapon, the method comprising:

molding an upper rigid member and a lower rigid member from a hardenable plastic;

forming a first slot in the upper rigid member;

fixedly joining a lower portion of a first blunt blade to the rigid lower member, the first blunt blade having the lower portion and an upper portion having a pointed tip and a forward-facing concave surface adjacent to the pointed tip;

inserting the first blunt blade into a substantially hollow housing portion through a first opening of the housing portion;

securing a first end of the housing portion associated with the first opening to the lower rigid member; and securing a second end associated with a second opening of the housing portion to the upper rigid member, such that the housing portion interconnects the upper rigid member and the lower rigid member.

12. The method of claim 11, further comprising aligning an outermost the tip portion of the first blunt blade with the first slot.

13. The method of claim 11, wherein the first end of the housing portion is secured to the lower rigid member via epoxy.

14. The method of claim 11, wherein the housing portion includes a flexible compressible material.

15. The method of claim 11, further comprising joining a lower portion of a second blunt blade to the lower rigid member.

16. The method of claim 15, further comprising inserting the second blunt blade into the first opening of the housing portion.

17. The method of claim 16, wherein the first blade and the second blade are substantially parallel to one another.

18. The method of claim 11, wherein the housing portion is configured to be compressed by a hand squeezing the upper rigid member and the lower rigid member together.

19. The method of claim 18, wherein the housing portion is configured to allow the pointed tip of the first blunt blade to protrude from the upper rigid member when the housing portion is compressed.

* * * * *